US007172145B2

(12) United States Patent
Knepp

(10) Patent No.: US 7,172,145 B2
(45) Date of Patent: Feb. 6, 2007

(54) CONCRETE DELIVERY TRUCK

(75) Inventor: Darrell Knepp, Sarasota, FL (US)

(73) Assignee: VM Fiber Feeder, Inc., Sarasota, FL (US)

( * ) Notice: Subject to any disclaimer, the term of this patent is extended or adjusted under 35 U.S.C. 154(b) by 795 days.

(21) Appl. No.: 10/368,107

(22) Filed: Feb. 15, 2003

(65) Prior Publication Data

US 2006/0071026 A1 Apr. 6, 2006

(51) Int. Cl.
*B02B 5/02* (2006.01)

(52) U.S. Cl. ..... 241/101.5; 241/101.74

(58) Field of Classification Search ..... 241/21, 241/22, 101.74, 101.5, 301; 366/33, 37, 366/50, 64, 68, 150.1, 153.1; 222/281, 252; 404/72

See application file for complete search history.

(56) References Cited

U.S. PATENT DOCUMENTS 5,316,197 A * 5/1994 Tobler et al. ..... 222/281
5,480,256 A * 1/1996 Itsekson et al. ..... 404/72
6,554,465 B2 * 4/2003 Cruso ..... 366/3

* cited by examiner

*Primary Examiner*—Faye Francis
(74) *Attorney, Agent, or Firm*—Thomas R. FitzGerald, Esq.; Hiscock & Barclay, LLP

(57) ABSTRACT

An apparatus and process for mixing and depositing a strand reinforced concrete mix at a job site from a concrete delivery truck including a mixer on the truck for mixing separate concrete ingredients at a job site, which truck further includes a fiber strand chopping device on the truck disposed and adapted to introduce chopped fiber strand lengths into the separate concrete ingredients and water and deposit the mix selectively at the job site without clumping and grouping of the fiber strand lengths in the mix.

4 Claims, 3 Drawing Sheets

CONCRETE DELIVERY TRUCK

FIELD OF THE INVENTION

This invention relates to concrete ingredient delivery trucks; and, more particularly, it is of an improved concrete ingredient delivery truck of that type which includes a mixing means and, also, includes a fiber strand chopping device for mixing of the ingredients and short chopped fiber strand lengths at a job site and selectively depositing the mixture to set up as fiber reinforced concrete.

SUMMARY IF THE INVENTION

This invention is of an apparatus and process for chopping and depositing short reinforcing fiber strand lengths into flows of separate concrete ingredients and water from a concrete ingredient delivery and mixing truck for job site mixing of short strand lengths, the concrete ingredients and the water and depositing the mix at the job site to set up there as fiber reinforced concrete.

The invention relates both to a process and to an apparatus on a concrete ingredients delivery and mixing trick for:

A) chopping, at a job site, short fiber reinforcing strand lengths from a continuous fiber strand supply on a spool carried on the truck by a strand drawing, chopping and ejecting means on the truck, B) depositing the chopped fiber strand lengths on an output flow of concrete ingredients and water from the truck, said output flow comprising:
   a) a flow of sand, usually wet,
   b) a flow of rocks, usually wetted, and,
   c) a flow of Portland cement, C) mixing the chopped fiber strand lengths and concrete ingredients to form a reinforced concrete mix by a mixing means on the truck in an output flow directing trough with a movable discharge end, and, D) dispensing the mix at the job site to set up as fiber reinforced concrete.

BACKGROUND

It is well known that there are concrete trucks for depositing concrete at a job site, for example, into a foundation ditch. Generally, there are two types of such trucks:

a) a first type of truck, which includes a rotatable, generally cone shaped, downwardly tilted turning drum in which a charge of cement, sand, rocks and water, and, sometimes, short lengths of reinforcing fiber lengths, are mixed in the turning drum while in transit to a job site and to be dispensed at the job site from the drum as a flowable mix onto one end of a chute extending from the truck; and b) a second type of truck, to which this invention is relevant, which is used to transport and dispense separate concrete ingredients in separate compartments which are carried to the job site by the truck; however, the ingredients are mixed at the job site, rather than in transit to the job site, and, then, they are dispensed from the truck.

With the second type of truck there has been a problem of adding short fiber reinforcing lengths to the combined output from the truck flow of separate concrete ingredient flows, so that, in the combined out flow from the truck, the short fibers lengths are not clumped or grouped, but, rather, are randomly dispersed generally in a quite uniform reinforced concrete mix. Past efforts to introduce chopped short fiber lengths into a flow of concrete ingredients have resulted in clumping or grouping of the fibers; and, as a consequence, the tensile strength enhancement sought of the concrete mix, when set, is not achieved. Past efforts have included hand dispensing of packaged pre-chopped short fiber lengths by dropping short lengths of chopped fiber directly onto an out flow of the concrete ingredients from the truck.

Although not described as being for a chopper for use on a truck, U.S. Pat. No. 5,316,197 describes an apparatus for depositing short fiber lengths onto a conveyor system; and this patent sets forth in some detail the past prior art problem, namely that of of clumping and grouping which this invention specifically addresses. In short, this invention is of an apparatus and of a process for developing a uniform concrete mix of concrete ingredients, water and short cut lengths of fiber strand at a job site and selectively depositing the mix on a delivery truck of the second type described above.

A general object of this invention is, therefore, to provide an apparatus and process which overcomes the past fiber strand grouping and clumping problem involved in delivering separate fiber strand reinforced concrete ingredients to a job site, mixing the ingredients at the site and depositing them to set up as fiber reinforced concrete in a structure being erected.

SUMMARY OF THE APPARATUS INVENTION

This invention is of an apparatus which includes a housing mounted on a truck constructed to transport and store a continuous fiber filament strand on a spool in the housing, and a strand withdrawing, chopping and ejecting means powered by a pneumatic motor in a cutting chamber in the housing with a discharge port for passage of the cut short fiber strand lengths under the influence of the exhaust from the motor. The process includes insinuating the cut strand lengths, preferably, at the confluence of separate conveyor conducted flows of sand, rocks, water and portland cement, as that mix is introduced from above into the mouth of a bowl with a lower discharge opening into one end of mixing trough, which usually includes an auger type mixer. The apparatus also includes conventional air flow metering means to control the revolutions per minute of the motor and, hence, the amount per cubic yard of cut fiber lengths introduced into the reinforced concrete mix.

Unless defined otherwise, all technical and scientific terms used herein have the same meaning as commonly understood by one of ordinary skill in the art to which this invention belongs. Although many methods and materials similar or equivalent to those described can be used in the practice of the present invention, the preferred methods and materials are described.

A strand, as that term is used herein, is a long or continuous length of a generally parallel, somewhat twisted, plurality of fiber reenforcing filaments which have been wound onto a supply spool. A short chopped fiber strand length is a length within the length range conventionally chopped from a continuous strand length in the conventional spray up method of making fiber reinforced materials; and its precise length of the short fiber strands is dictated by the circumference of the chopper elements and the circumferential spacing of the cutter blades from one another.

DESCRIPTION OF THE INVENTION IN A PREFERRED EMBODIMENT

Figure 1:
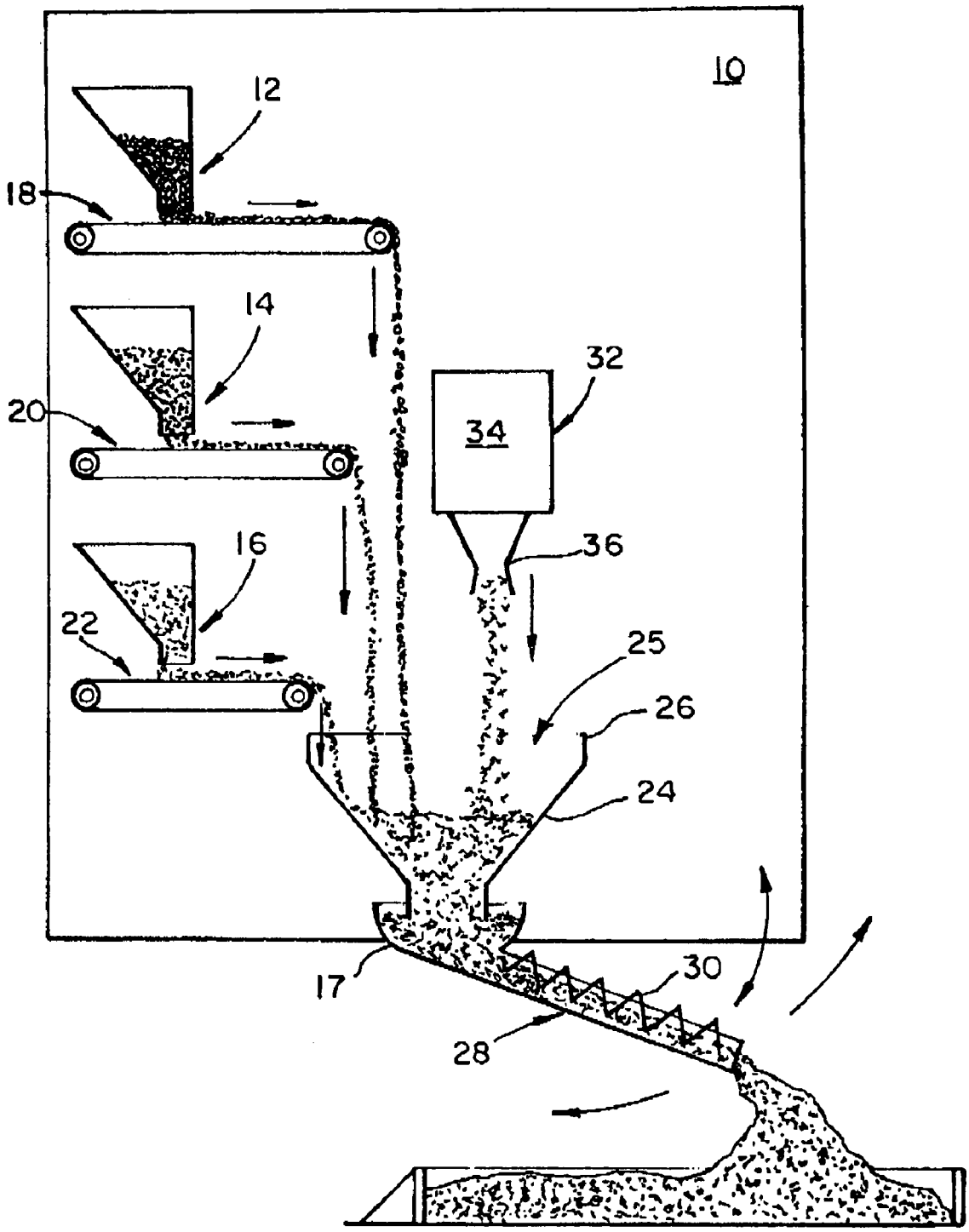
FIG. 1 is a schematic drawing of the process.
Figure 2:
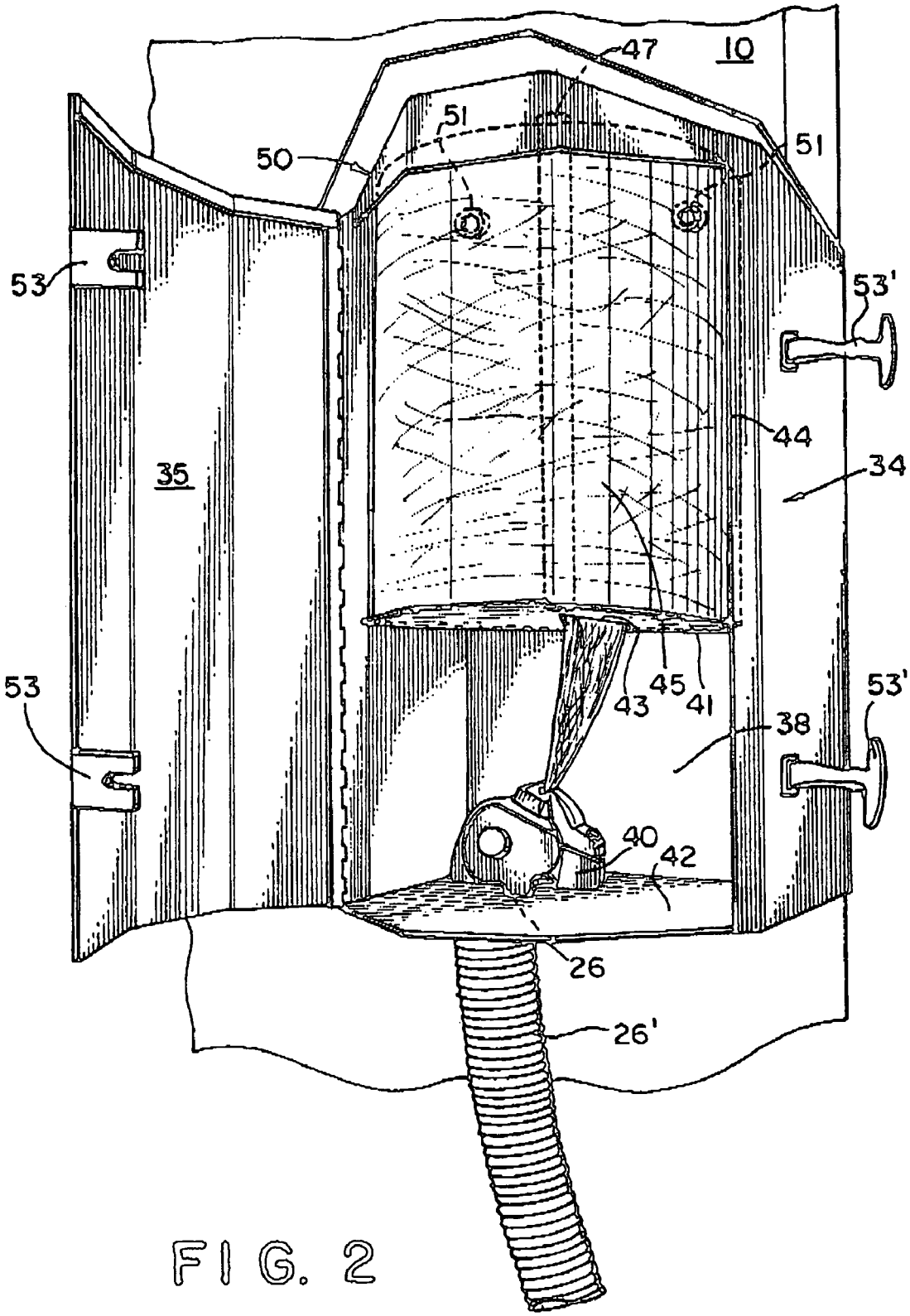
FIG. 2 is a general view of a portion of the invention on a portion rear of a conventional concrete truck ingredient delivery and mixing truck of the type described above with the inventive apparatus being generally illustrated.

Referring to the schematic drawing, FIG. 1, the rear of a truck 10 is indicated. The truck includes, as is conventional, in addition to a means, not shown, to introduce water into concrete ingredients, a first, second and third main chamber, 12, 14 and 16, each including a conveyor means, or concrete ingredient moving means, 18, 20 and 22 of a conveyor system including a drive means, and a funnel type structure, as indicated at 24, with an open mouth 26 at a common output confluence zone 25 for receiving the discharge flows of the respective conveyor means to direct them onto the collection end of a swingable trough defining chute 28 which includes a concrete ingredient moving and mixing means 30, usually an auger type to travel the mix to the discharge end 17 of the chute. The drawing, chopping and ejecting means of this invention is designated by the numeral 32. It has a housing 34 and a chopped fiber length discharge opening 36, preferably located closely adjacent and just above the aforesaid confluence zone 25 with the output from the chopper rollers being directed through the discharge opening and toward the ingredients to be mixed and discharged from the chute.

A more detailed description of the conventional structure of the type of concrete ingredient delivery and mixing truck on which the chopping apparatus is installed will not be provided so that this specification does not become prolix.

In general, the apparatus of the invention includes the housing 34 with an access door 35, or access means. Within the housing, there is a chopping chamber 38 with a fiber strand chopper means 40 in a fixed position on the housing floor 42 below a horizontal wall 41 separating the housing interior into the chopper chamber 38 and an adjacent supply chamber 44. The chopper means 40 serves the functions of drawing fiber strand from a spool 45, chopping short lengths from it and ejecting the short fiber strand lengths. The chopping chamber 38 includes an outlet port which may include a mouth defining portion 26 to direct the output of chopped strands from the chopping chamber onto the concrete ingredients to be mixed together. In the chamber separating wall 41 there is a smoothly rimmed opening 43 for passage of the strand as it is drawn by the chopper means from a spool 45 on a shaft 47 in the supply chamber 44 on which it may rotate. Means mounting and positioning the housing 50 on the rear truck panel, preferably on the rear panel, are provided, such as a set of screws the head of one of which is designated by the numeral 51. The access door 35 includes the mutually cooperating locking means 53 53,' as shown; or any other suitable means to hold the door closed or to open it may be employed.

Figure 3:
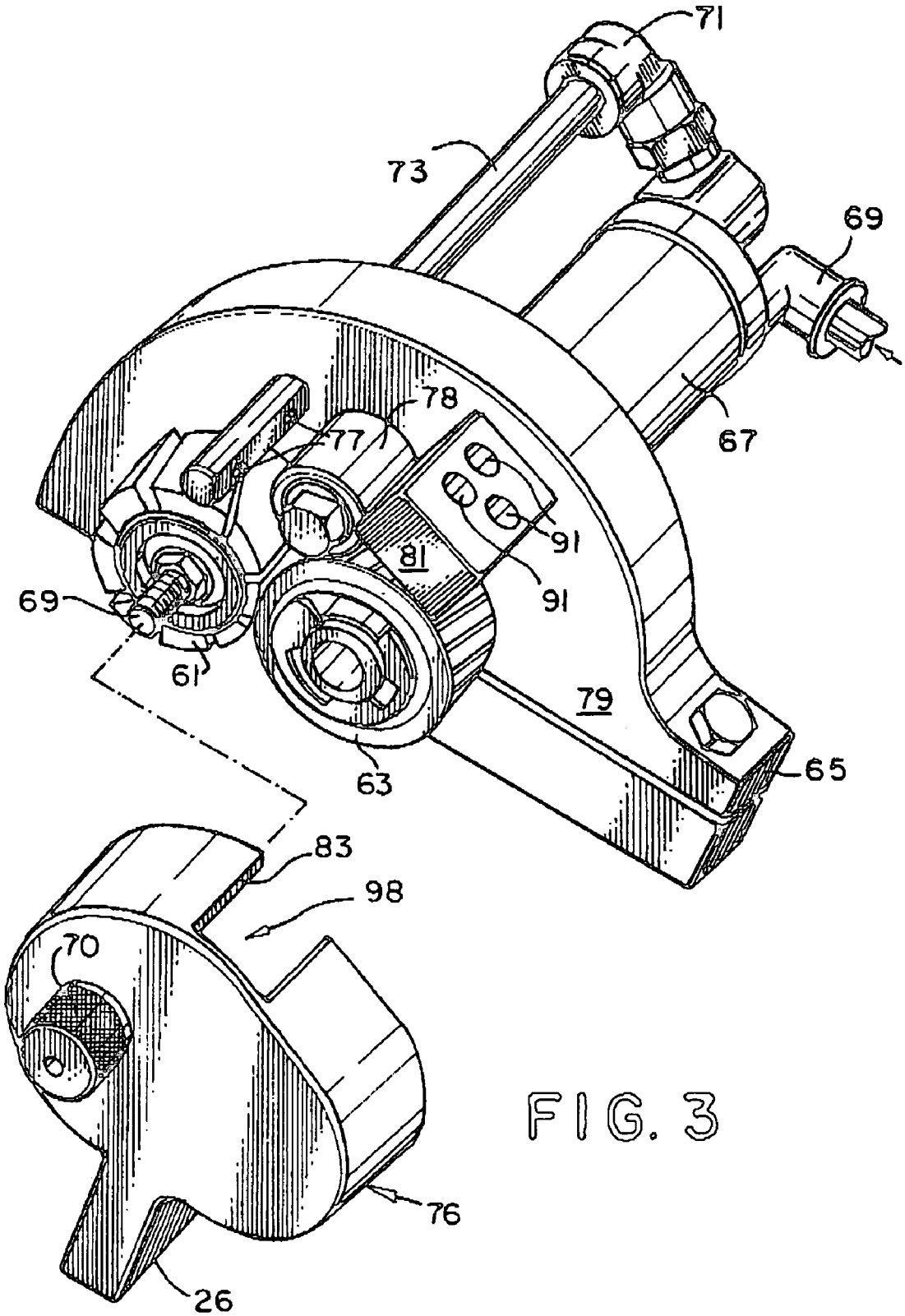
FIG. 3 is an exploded view of the parts of the fiber strand drawing, chopping and ejecting apparatus.

As seen in FIG. 3, the chopper means 40 is generally a conventional type. It includes a blade equipped cutter roller 61 and an opposing driving roller 63 which, as shown, are on a fixed frame 65 and driven in a conventional manner by a pneumatic motor 67 also mounted on the frame 65. The motor has a gas inlet 69 and an outlet 71, the latter being provided with a tubular exhaust flow directing means 73 which feeds the exhaust into a closed, somewhat pressurized, collection and ejection space 98 between the frame and a cover 76 in which there is a cut strand discharge opening 26. This opening or mouth 76 may be provided with a tubular hose 26' for directing the severed short fiber lengths away from the cutter means. The fixed frame 65 includes an extending portion or lug 81 in which there is hole or mouth 91 for introducing strand into the cutting space 98.

In use, the end of the strand is fed through the rimmed hole 43 in the wall 41 and into the cutter chamber 44, through a smooth hole 91 in lug 81 and by a pinch or idle roller 78 of the cutter means 40. The cover 76, which together with the frame surface 79 closes a space 98 where the actual chopping takes place, is replaced and secured by the bolt 70. The lug 81, on the frame and the cutout 83 in the cover are helpful in positioning, orienting and maintaining the parts in the correct relation to one another in assembly. The motor, when energized by a supply of compressed air, drives the cutter means; and its exhaust, is released into the space 98 between the frame and cover, which causes a force that tends to separate the cut fiber strand lengths and move them out of the housing through the mouth structure 26, which may include a hose length 26' and onto the concrete ingredients to be mixed in the mixing means 30 of the truck at a job site.

While the principles of the invention have been made clear in the illustrative embodiment, there will be immediately obvious to those skilled in the art that many modifications of structure, insofar as arrangement, proportions, and the elements, materials, and components and as well in the process used in the practice of the invention, can be made, which are particularly adapted to specific environments and operative requirements described hereon, without departing from those invention principles. The appended claims are therefore intended to cover and embrace any and all such modifications, within the limits of the true purview, spirit and scope of the invention as set forth in the claims and within the doctrine of equivalents.

What is claimed is:

1. In combination

A. A concrete ingredient transport and ingredient mixing truck including:

separate compartment defining structure defining separate chambers in the truck, each chamber having a discharge port opening for a separate concrete ingredient contained therein;

a conveyor system means including a drive means for conducting a discharge flow of the ingredients from the separate chamber discharge ports to a common discharge and confluence zone of the discharge flows, and a discharge trough having two opposite ends, a collection portion at one of its ends positioned, when in use, below the confluence zone, and a concrete ingredient discharge portion at its other end positioned, when in use, below the collection portion, and moving and mixing means in the trough between the ends to travel the concrete ingredients under the influence of gravity between the ends and to mix the concrete ingredients including water when moving between the ends, and B. an apparatus including a housing having a chopping chamber with a lower portion having an an output port in the lower portion of the chopping chamber, fiber strand spool supporting means on the housing having a smoothly rimmed opening into the chopping chamber, filament drawing, chopping and ejecting means in the chopping chamber to draw strand from the spool through the smoothly rimmed opening into the chopping chamber, to chop short reinforcing lengths from the strand, and to eject the chopped lengths toward and though the chopping chamber output port, pneumatic drive means having an input port and an output port in the housing to drive the fiber drawing, chopping and ejecting means, said drive means including conducting means connecting the output port of the drive means to direct exhaust discharge from the drive means into the chopping chamber and onto the drawing, chopping and ejecting means, and means mounting and apparatus positioning means on the housing to mount and position the apparatus on the truck with the chopping chamber outport port above the discharge zone to introduce and mix short chopped reinforcing filament lengths with the concrete ingredient flows between the trough ends.

2. The combination asset forth in claim 1 wherein the housing has a supply chamber and includes a wall separating the supply chamber from the chopping chamber, said wall having a smooth inlet into the chopping chamber.

3. The combination as set forth in claim 1 wherein said moving and mixing means comprises an auger means.

4. A device for a concrete ingredient delivery and ingredient mixing truck which includes means for initiating the mixing and completing the mixing of the concrete ingredients at a job site, and means for depositing the mixed concrete ingredients at the site, said device comprising a housing including a support for a spooled continuous concrete fiber reinforcing strand and having a chopping chamber, and said housing comprising a wall having a smoothly rimmed opening into the chopping chamber and access means for the chamber;

a fiber strand drawing, chopping and ejecting means in a fixed position in the chopping chamber including a pneumatic drive means with an air inlet and an exhaust opening in the chopping chamber, said housing having a chopped strand discharge mouth in the chopping chamber to direct a flow of chopped fiber strand lengths from the housing, and means to mount the housing on a truck and to position the housing so that the directed flow of chopped fiber strand lengths impinges on the concrete ingredients to be mixed, and tubular means to conduct exhaust air from the pneumatic drive means and direct its flow into the chopping chamber.

* * * * *